US012319531B2

(12) United States Patent
Fornos Jove

(10) Patent No.: US 12,319,531 B2
(45) Date of Patent: Jun. 3, 2025

(54) SORTING MODULE FOR BAG CHECKING MACHINES

(71) Applicant: LAPEYRA Y TALTAVULL COMERCIAL, S.L., Barcelona (ES)

(72) Inventor: Alejandro Fornos Jove, Barcelona (ES)

(73) Assignee: LAPEYRA Y TALTAVULL COMMERCIAL, S.L., Barcelona (ES)

( * ) Notice: Subject to any disclaimer, the term of this patent is extended or adjusted under 35 U.S.C. 154(b) by 0 days.

(21) Appl. No.: 18/044,211

(22) PCT Filed: Sep. 2, 2021

(86) PCT No.: PCT/ES2021/070637
§ 371 (c)(1),
(2) Date: Mar. 7, 2023

(87) PCT Pub. No.: WO2022/053728
PCT Pub. Date: Mar. 17, 2022

(65) Prior Publication Data

US 2023/0339717 A1 Oct. 26, 2023

(30) Foreign Application Priority Data

Sep. 10, 2020 (ES) ..... ES202031975U

(51) Int. Cl.
*B65H 29/58* (2006.01)
*B65H 43/04* (2006.01)

(52) U.S. Cl.
CPC ..... *B65H 43/04* (2013.01); *B65H 29/58* (2013.01); *B65H 2301/4474* (2013.01); *B65H 2404/632* (2013.01); *B65H 2701/191* (2013.01)

(58) Field of Classification Search
CPC . B65H 29/58; B65H 43/04; B65H 2301/4474
(Continued)

(56) References Cited

U.S. PATENT DOCUMENTS 5,287,952 A * 2/1994 Redaelli ..... B65G 47/647 198/448
5,732,609 A * 3/1998 Marschke ..... B65H 29/60 83/167

(Continued)

*Primary Examiner* — Douglas A Hess
(74) *Attorney, Agent, or Firm* — Stanzione & Associates, PLLC; Patrick Stanzione

(57) ABSTRACT

Sorting module for bags checking machines, of the type that are installed before the bag can enter the checking machine comprising driving means that activate the module, and in that comprises:

a pressure roller (102) that puts pressure on the bags (1) as they pass through under said roller (102), which has an ascending and a descending motion, a first input roller (101) connected to conveyance means (4) of the checking machine and to the pressure roller (102), and at least one automatic or manually-operated diverter element (103) positioned bellow pressure roller (102), which has at least two positions, a first upward position that blocks the passing of the bags towards the conveyance means (4) and guides the bags towards another predetermined destination, and a second downward position that defines a passage (105) formed by the conveyance means (4), said diverter element (103) blocks the passing of the bags (1) towards the other predetermined destination and guides the bags (1) towards the passage (105).

12 Claims, 7 Drawing Sheets

(58) Field of Classification Search
USPC ..... 198/348, 369.2
See application file for complete search history.

(56) References Cited

U.S. PATENT DOCUMENTS

| | | | | |
|---|---|---|---|---|
| 6,419,217 | B1 * | 7/2002 | Hartmann | B26F 3/002 226/110 |
| 6,708,813 | B2 * | 3/2004 | Takahashi | B65G 47/647 198/813 |
| 8,069,968 | B2 * | 12/2011 | Zimmermann | B65H 29/58 198/369.2 |
| 8,439,184 | B2 * | 5/2013 | Jorgensen | B65G 21/2054 198/626.1 |
| 8,528,721 | B2 * | 9/2013 | Eiserloh | B65H 29/58 198/360 |
| 8,636,135 | B2 * | 1/2014 | Yamamoto | A61F 13/15764 198/367.1 |
| 8,789,683 | B2 * | 7/2014 | Gadliger | B65H 29/66 198/457.07 |
| 8,936,243 | B1 * | 1/2015 | Muir | B65H 5/26 271/302 |
| 9,994,397 | B2 * | 6/2018 | Hetzer | B65B 23/14 |
| 10,087,006 | B2 * | 10/2018 | Franzaroli | B65B 35/44 |
| 10,252,437 | B2 * | 4/2019 | Adami | B26D 7/1818 |
| 10,525,509 | B2 * | 1/2020 | Chapelet | B65G 47/46 |
| 11,400,492 | B2 * | 8/2022 | Berger | B65G 47/647 |

* cited by examiner

SORTING MODULE FOR BAG CHECKING MACHINES

Sorting module for bag checking machines, of the type that are installed before the bag enters the checking machine, comprising driving means that activate the module, and in that it comprises: a pressure roller that puts pressure on the bags as they pass through bellow said roller, which has an ascending and a descending motion, a first input roller being connected to conveyance means of the checking machine and to the pressure roller, and at least one automatic or manually-operated diverter element positioned under pressure roller, which has at least two positions, a first upward position that blocks the passing of the bags towards the conveyance means and guides them towards another predetermined destination, and an a second downwards position that defines a passage formed by the conveyance means while said diverter element blocks the passing of the bags towards another predetermined destination and guides them towards the passage.

BACKGROUND OF THE INVENTION

Different machines and systems for quality control in bags manufacture are known in the state of the art.

Thus is Spanish Patent n. 200901048 (ES2347513) "BAG DISPENSING DEVICE, BAG DISPENSING MACHINE COMPRISING SAID DEVICE AND AUTOMATED METHOD FOR PACKING BAGS", of the year 2009, in the name MACFER ENGINEERING, S.L., which relates to a bag dispensing device, especially for bags that have a previously folded part that is superimposed in a lateral wall of the bag, enabling the bag supply and control process to be automated by means of the arrangement of a sorting element provided with a pair of rotating elements, such that it selects, using control means, with artificial vision, the dimensionally correct bags from the bags that have some type of shape defect. The invention relates to a bag dispensing machine provided with a dispensing device of the above-mentioned type.

Also state of the art is Patent WO2016/166452 "METHOD AND MACHINE FOR SORTING BAGS", of the year 2016, in the name HOLWEG GROUP, which refers to a method for sorting bags that comprises the following steps: the bags are provided by passing in plates, one after the other, being separated by a gap; the external edges of each bag is checked to determine if the plate and the position of the bag correspond to a calibrated bag or to a non-calibrated bag; non-calibrated bags are discarded; the calibrated bags are presented before the visual inspection system to determine the acceptable or non-acceptable quality of the inspected bag; and the acceptable bags are stacked and the non-acceptable bags are discarded after having passed by the visual inspection system. The invention also refers to a machine that implements the method.

It is also worth mentioning German Patent n. 4417121 "DEVICE FOR STACKING OF ESP. PAPER BAGS", of the year 1994, in the name WINDMOELLER & HOELSCHER, which refers to a machine having a drum that conveys bags by gripping them by means of clamps, the bags being held by the perimeter of the drum and being released vertically into a box and being arranged vertically, and the last bag pushes all the previous group of bags to make room for itself and be stored with the group of bags.

Known is also Patent WO2010/133597 "DEVICE FOR DETECTING SHAPE FLAWS OF TUBULAR BAG BODIES", of the year 2010, in the name STARLINGER & CO GESELLSCHAFT M.B.H., which refers to a device for detecting flaws in the tubular bags bodies shapes, in particular in bag bodies folded to form rectangular-cuboid-shaped bags, while the bag bodies are transported along a conveying path on a conveying apparatus, comprising at least one contour sensor for detecting the contour of a bag body and a comparison apparatus for comparing the detected contour of the bag body with a desired contour, wherein the comparison apparatus sends out a shape flaw signal if the deviation between the detected contour of the bag body and the desired contour exceeds a predefined threshold. The comparison apparatus compares the detected contour of the bag body with a surrounding curve that represents the desired contour. The invention also refers to a device for producing bags from tubular bag bodies, comprising a shape flaw detection device.

Further, the European Patent EP2724964A1 "Sheet sorting/conveying apparatus", of the year 2014 in the name of Kabushiki Kaisha Toshiba is known in the technical field. It relates to a sheet sorting/conveying apparatus which includes a conveying unit, a sorting lever, a guide roller, and a positioning unit. The conveying unit pinches and conveys a sheet. The sorting lever guides the sheet pinched and conveyed by the conveying unit, in a first conveying direction or a second conveying direction different from the first conveying direction. The guide roller is opposed to the sorting lever and configured to guide the sheet being conveyed. The positioning unit applies a force elastically to the guide roller, thereby to set the guide roller at a prescribed position. The guide roller retreats from the prescribed position against the force applied by the positioning unit, upon receiving a force from the sheet being pinched and conveyed by the conveying unit.

Last, the Applicant company is also the owner of Patent WO2019115840 "SYSTEM FOR CHECKING BAGS, VISUAL BAG INSPECTION MACHINE AND BAG CONVEYOR MACHINE", of the year 2018, which refers to a system for checking bags, a visual inspection bag machine and a bag conveyor machine that comprises a first stage wherein some supply means supply some bags to be checked, characterized in that it comprises: a second stage wherein the first visual inspection means or cameras check, according to a pre-established pattern, if the bottom of the bag is within said parameters, accepting it if it observes them and sending it to the third stage, or rejecting it if it does not observe them; and a third stage wherein some packaging means package those accepted bags. Claim 14 and subsequent of the Patent describe a bag conveying machine of the type comprising a rotating drum, driven by certain driving means and a bag retention means, characterized in that it comprises a first manual or automatic discriminator that deviates the bags towards a third container or to the following machine.

BRIEF DESCRIPTION OF THE INVENTION

This patent application falls within the field of the machines for controlling bag manufacturing.

The nearest document is German Patent n. 4417121.

Said patent solves the problem of selecting two types of bags by means of a discriminator adopting two positions: one position that allows the bag to proceed through the drum, and another position that removes the bag from the drum and redirects the bag towards another machine or towards a bag warehouse.

The problem arises because in the case of bags advancing towards another machine or warehouse, if the bag has a small defect, it may be thrown above the other machine due to the impulse and the acceleration conveyed by the drum.

The inventors have solved this problem by adding a pressure roller above the diverter element that covers the diverter element, such that said pressure roller becomes an upper stopper for the bags that must continue to move forward, through the inner passage or, if the bags are deviated towards a different predetermined destination.

In this manner, the bags are prevented from being thrown away through the top by the effect of the acceleration carried from the previous machine or workstation, and from the possibility that the contact with the diverter element may cause them to lose continuity by rising above the conveyance means.

Furthermore, an advantage of the present invention is that it may be installed in checking machines of the types currently used, thanks to the versatility of the module.

An object of the present invention is a sorting module for bag checking machines of the type that is installed before the bag is able to enter the checking machine, which machine comprises driving means that activate the module, characterized in that it comprises: a pressure roller that puts pressure on the bags as they pass through under said roller, which has an ascending and a descending motion, a first input roller being connected to conveyance means of the checking machine and to the pressure roller, and at least one automatic or manually-operated diverter element, positioned bellow del pressure roller, which has at least two positions, a first upward position that blocks the passing of the bags towards the conveyance means and guides them towards another predetermined destination, and an a second downwards position that defines a passage formed by the conveyance means while said diverter element blocks the passing of the bags towards the other predetermined destination and guides them towards the passage.

BRIEF DESCRIPTION OF THE DRAWINGS

To facilitate the explanation of the invention, seven sheets of drawings are included herein. The drawings represent a practical embodiment, which is cited as a non-limiting example of the scope of the present invention, in which.

SPECIFIC EMBODIMENT OF THE PRESENT INVENTION

Figure 1:
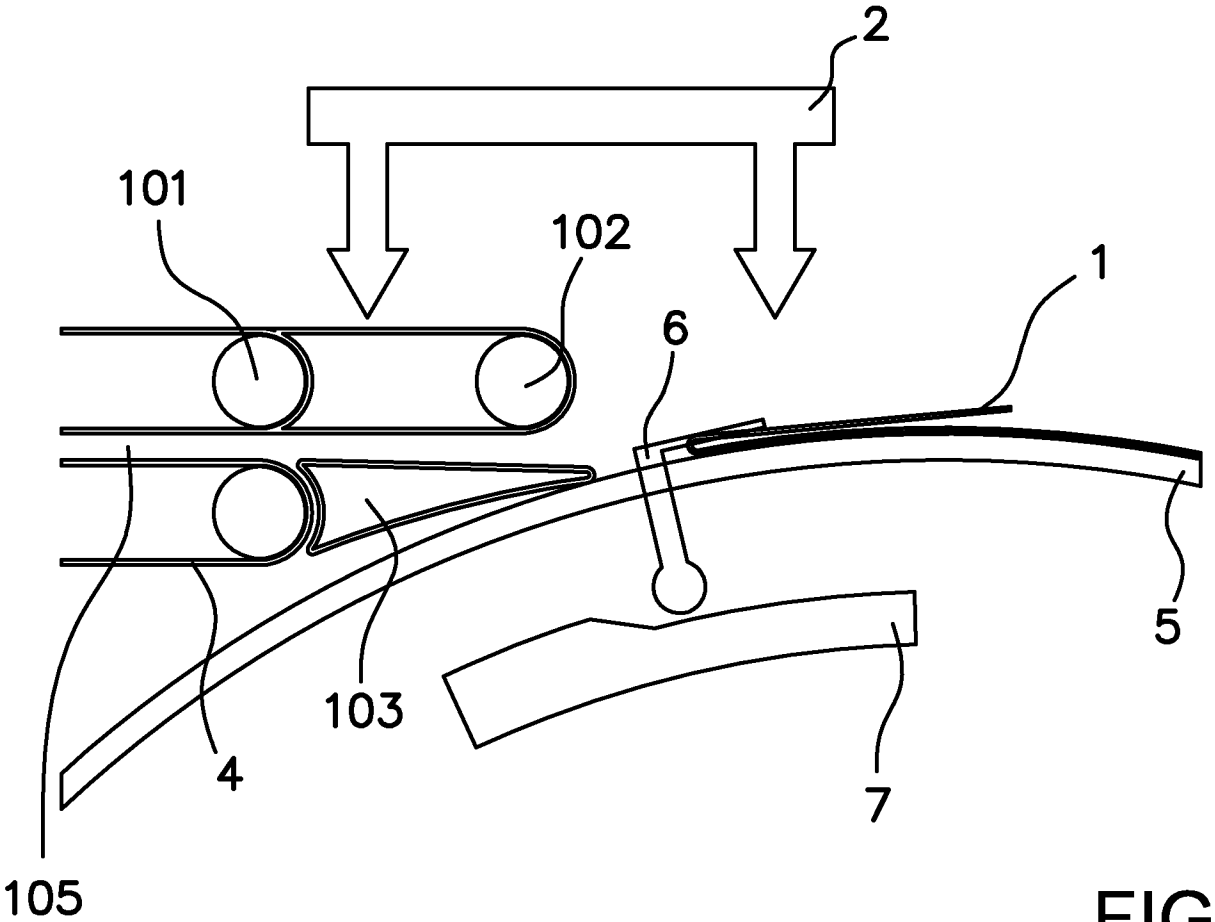
FIG. 1 is a view of the general operation of the module, in a position of passing towards the passage when the bag is coming from a drum machine.
Figure 2:
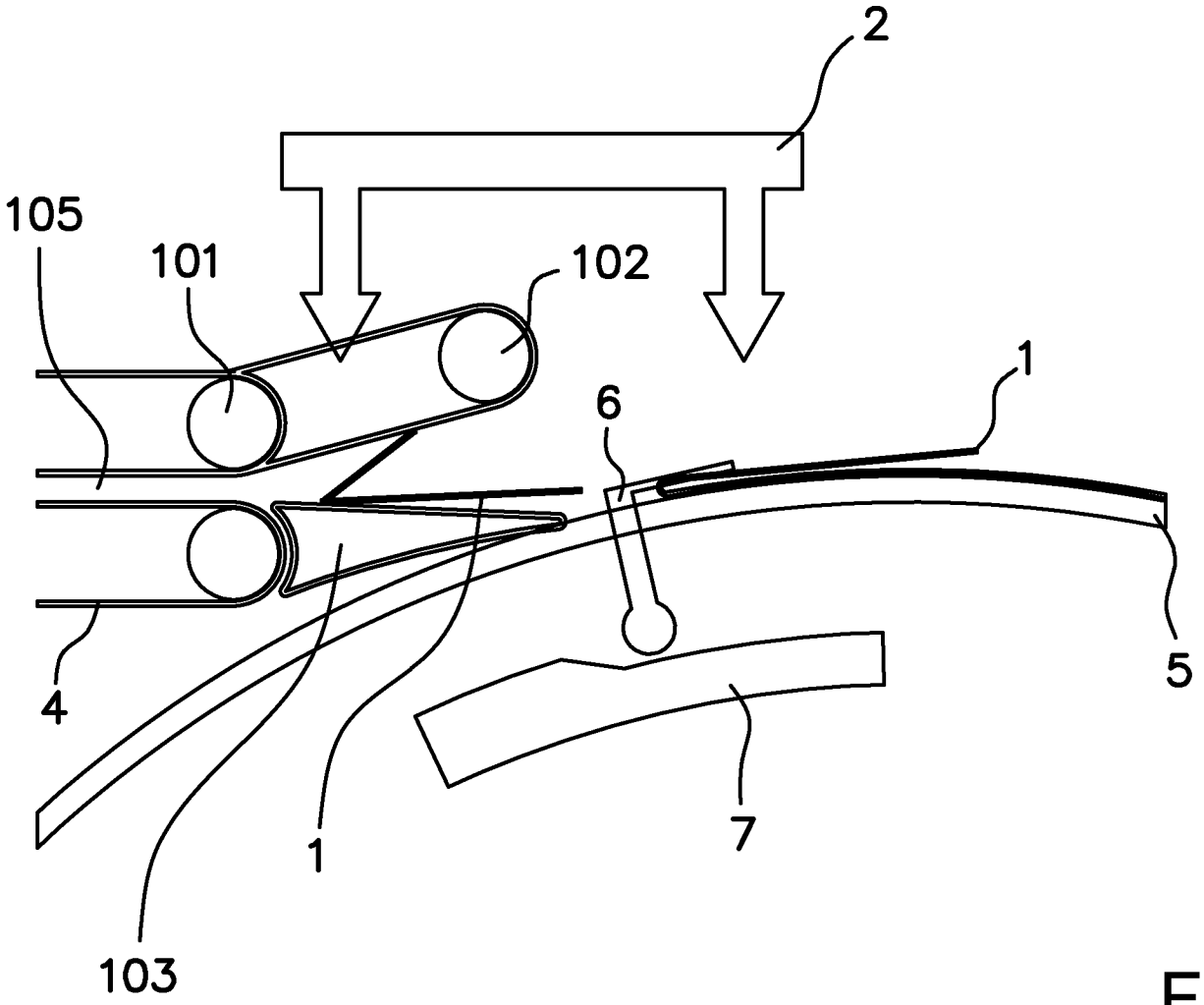
FIG. 2 is a view of FIG. 1 with a simulation of a jam.
Figure 3:
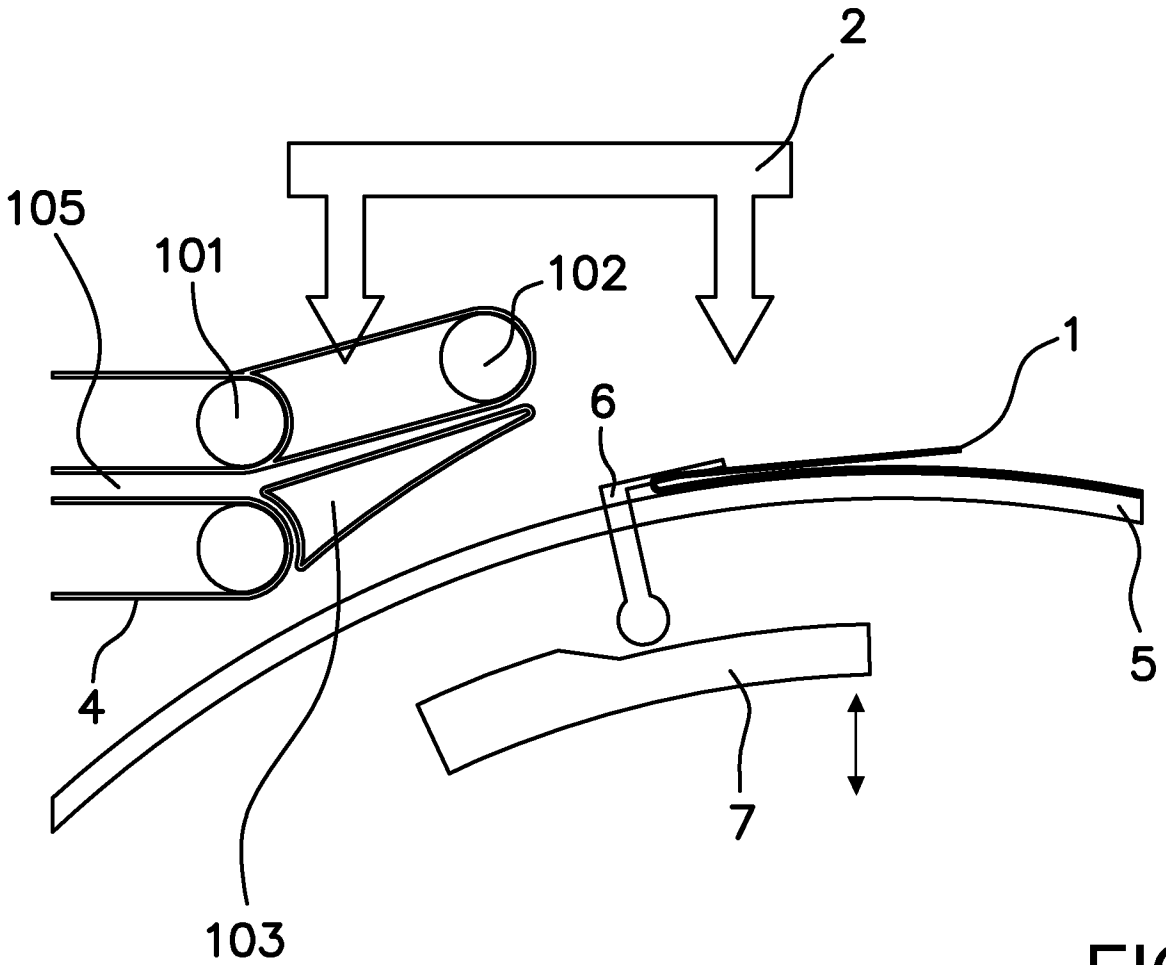
FIG. 3 is a view of the general operation of the module in a position of passing towards the predetermined destination when the bag is coming from a drum machine.

FIGS. 1, 2 and 3 show a bag 1, passing means 2, conveyance means 4, a drum 5 having an outer gripper 6 and a cam 7, a first input roller 101, a pressure roller 102, a diverter element 103 and a passage 105.

Figure 4:
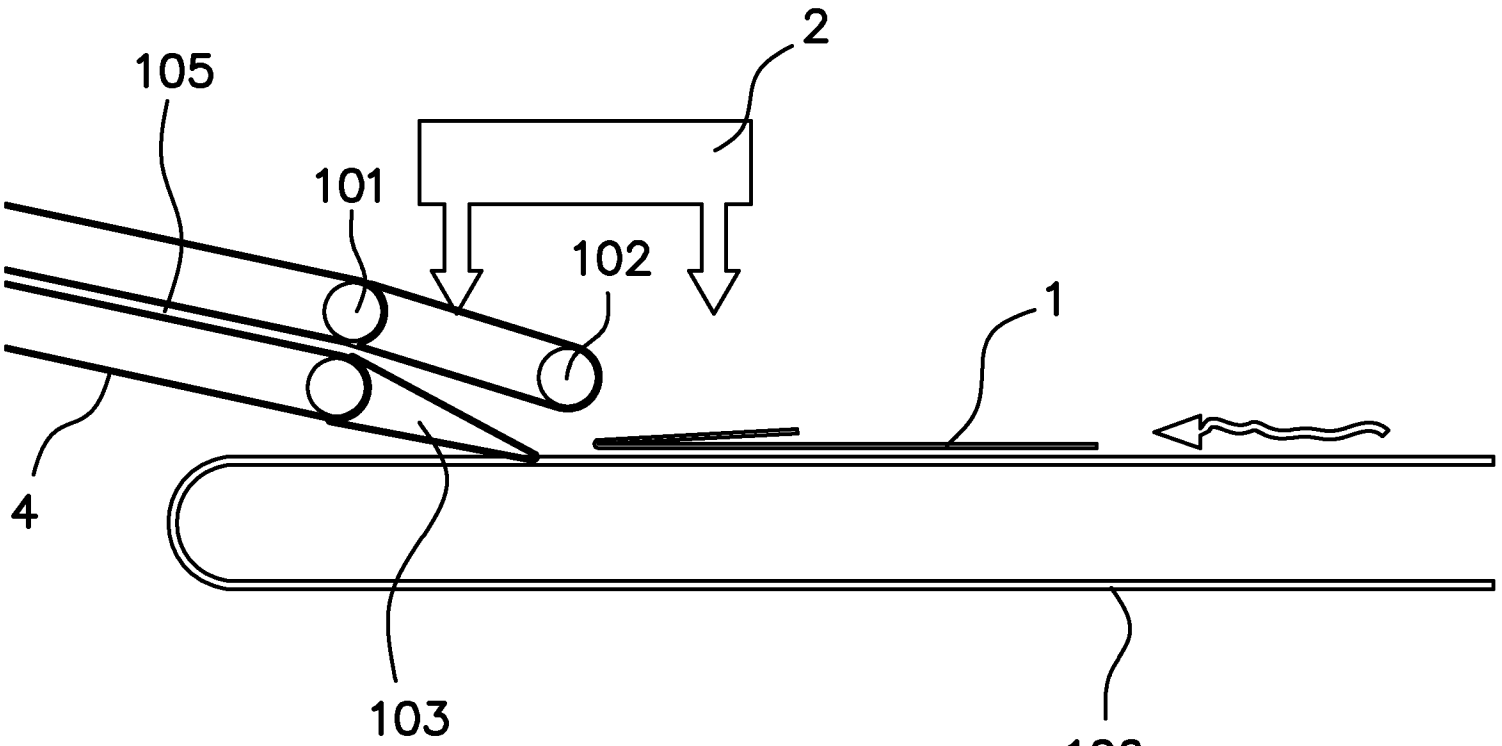
FIG. 4 is a view of the general operation of the module in a position of passing towards the passage when the bag is coming from a flat conveyor belt.
Figure 5:
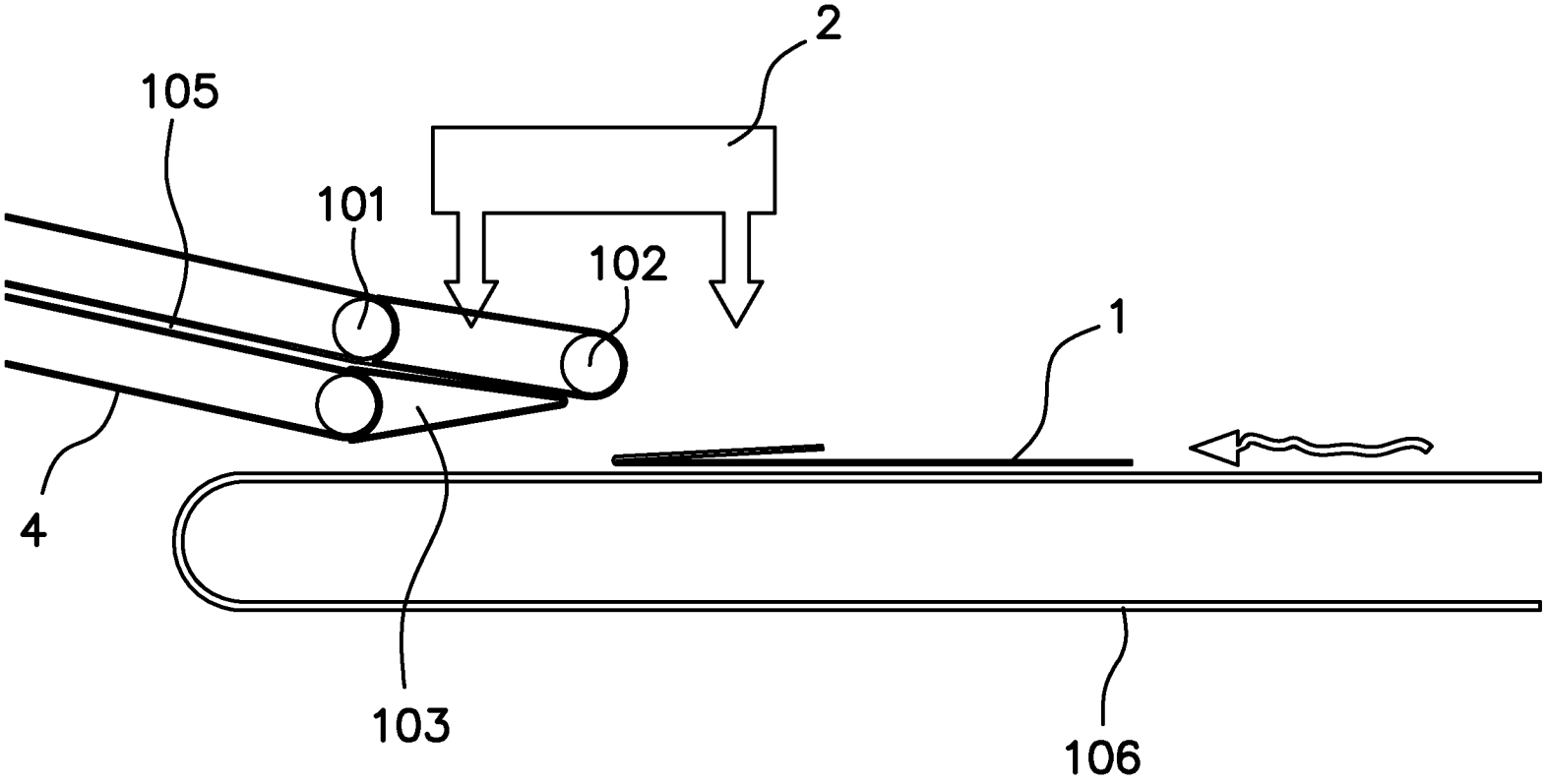
FIG. 5 is a view of the general operation of the module, in a position of passing towards the predetermined destination, with the bag coming from a flat conveyor belt.

FIGS. 4 and 5 illustrate bag 1, passing means 2, conveyance means 4, first input roller 101, pressure roller 102, diverter element 103, passage 105 and a conveyance belt 106.

Figure 6:
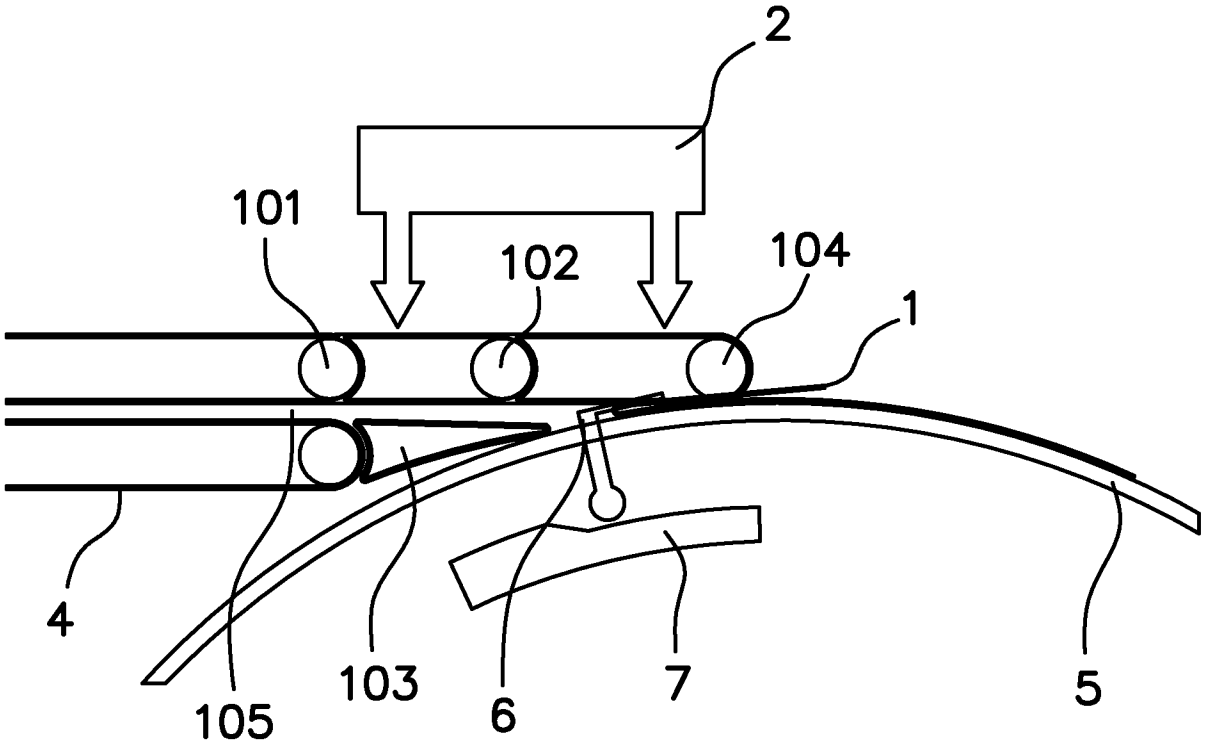
FIG. 6 is a modification of FIG. 1 by adding a second input roller.

FIG. 6 illustrates bag 1, passing means 2, conveyance means 4, drum 5, outer gripper 6, cam 7, first input roller 101, pressure roller 102, diverter element 103, passage 105 and a second input roller 104.

Figure 7:
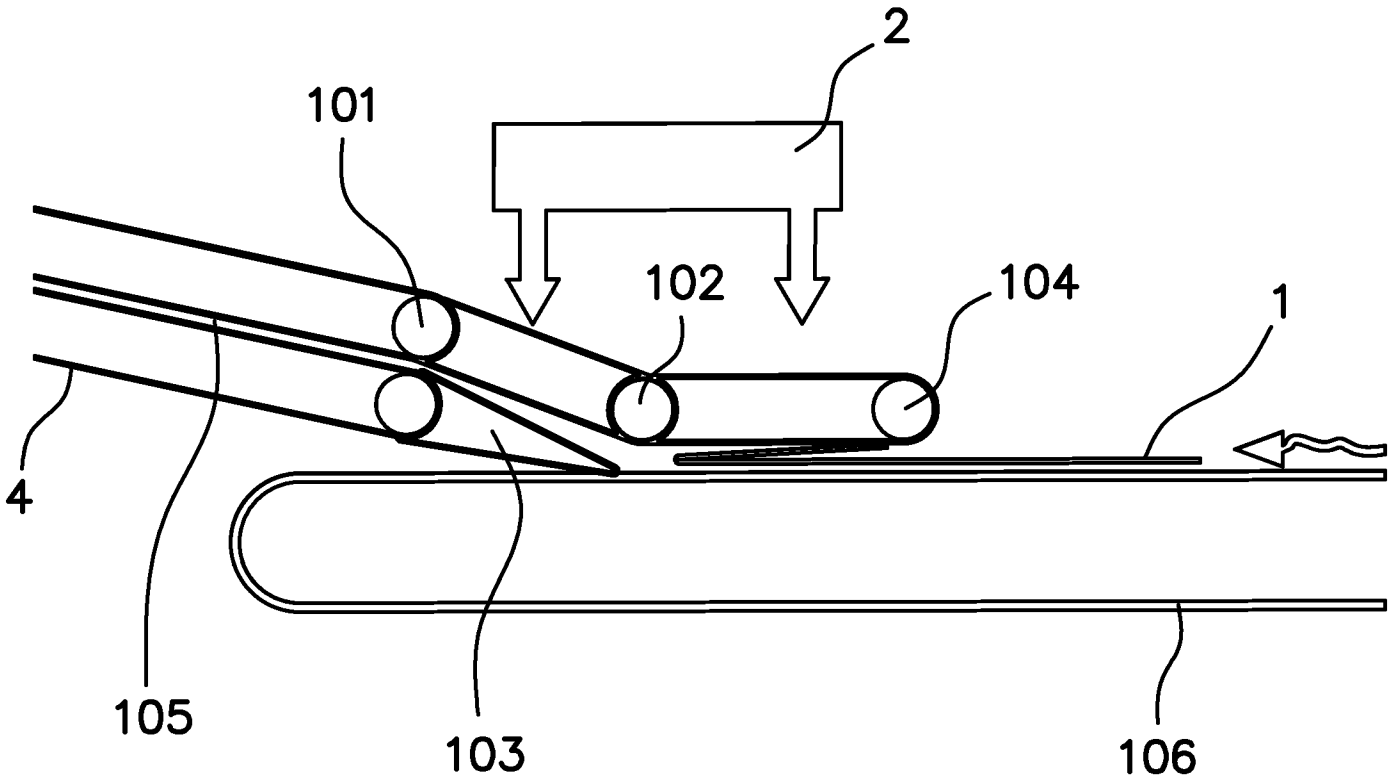
FIG. 7 is a modification of FIG. 4 by adding a second input roller.

Last, FIG. 7 shows bag 1, passing means 2, conveyance means 4, first input roller 101, pressure roller 102, diverter element 103, second input roller 104, passage 105 and conveyor belt 106.

Thus, in a practical embodiment, the present sorting module for bag checking machines, is one of the types that are installed before the bag enters the checking machine, that is, between the bag feeder machine and bag checking machine.

This module comprises driving means of a known type (not shown) that activate the module, for example, a servo motor.

The module comprises a pressure roller 102 that puts pressure on the bags 1 as they pass through under said roller 102. It should be noted that this pressure roller 102 has an ascending motion that allows that any bags 1 that could have been blocked or trapped to be detected by the passing means 2 to pass, and a descending motion to recover its initial position.

The upward motion can also be used to facilitate the passing of the bags 1 on their way to the predetermined destination, allowing the diverter element 103 to fully free the flow of the bag 1 (FIG. 3).

In addition, the module comprises a first input roller 101 that is connected to the conveyance means 4 of the checking machines and to the pressure roller 102.

EI pressure roller 102 may be driven by the conveyance means 4 and be formed as a part of the conveyance means 4, as it is shown in the drawings. Otherwise, the pressure roller 102 can be driven by its friction with the drum 5 or the conveyor belt 106 or by independent driving means, such as an engine.

The module in addition comprises at least one diverter element 103 (the number of the diverter elements 103 will depend on the width of the module) that can be automatic or manually driven, that is, it will be either started by the passing means 2 upon detecting the jam, or an operator will start it manually upon reception of a signal from the passing means 2.

The diverter element 103 is positioned under del pressure roller 102, and has at least two positions, a first upward position which blocks the passing of the bags towards the conveyance means 4 (FIGS. 3 y 5) and guides them towards another predetermined destination.

The second position arranges the diverter element 103 downwards (FIGS. 1, 2, 4, 6 and 7) which thus defines a passage 105 formed by the conveyance means 4; the diverter element 103 thus blocks the passing of the bags 1 towards the other predetermined destination and guides them towards the passage 105.

Optionally, the module can comprise a second input roller 104 connecting the pressure roller 102 (FIGS. 6 y 7) that allows keeping the bag 1 under pressure and to continue its due course towards the passage 105 or to the predetermined destination.

One of the possible embodiments of the diverter element 103 is in the form of a, as shown in the figures, but other shapes or configurations could be used depending on the machines in which the module is to be fitted. The number of nails will depend on the size of the module, starting from one nail.

As above stated, one of the embodiment comprises that when the nails 103 are in the upwards position, the pressure roller 102 is likewise moved upwards, the nails 103 thereby completely blocking the passing of the bags 1 to the conveyance means 4 (FIG. 3), thus facilitating the passing of the bags to the predetermined destination.

Optionally, when the passing means 2 detect a delay in the passing of the bags 1, the pressure roller 102 moves upwards and, if the passing means 2 keep detecting the delay, they cause the nails 103 to move to the upwards position, thus blocking the passing of the bags 1 to the conveyance means 4 (FIG. 2). In other words, at a first moment, the passing means 2 attempt to let the bag that is delayed, for example, because it is higher than the normal, to pass towards the passage 105 by elevating the pressure roller 102 to avoid a jam. If this fails, the nails 103 move upwards, redirect the bags to the predetermined destination, and gradually stop the machines in use to allow the jammed bags 1 to be removed.

Constructively, it can be configured that the first input roller 101 be formed integrally with the conveyance means 4, thus facilitating both the operation and the implementation of the modules.

The module works similarly when the feeding machine is fed by the drum 5 and when it is fed by the conveyor belt 106.

If a conveyor belt 106 is used, the same conveyor belt 106 leaves bag 1 near the diverter element 103 and if the diverter element 103 is in a position for conveying the bag 1 to the passage 105, it will divert its course and make the bag 1 pass under the pressure roller 102 and then through the first input roller 101, which provides for its admission into passage 105.

If the passing means 102 detect a problem, the pressure roller 102 will be elevated to let the bag 1 pass anyway. If the passing means 102 detect that the bag 1 has still not passed, they will change the diverter element 103 so that the bags 1 continue their course through the conveyor belt 106 until a different predetermined destination and, at the same time, the machine will gradually come to a stop.

If a drum 5 is provided, the bag 1 would be released from the outer gripper 6 by the interaction of the cam 7 in the manner described in document WO2019115840 of the same applicant.

Once the passing means 2 detect the jam, they will anyway rise the pressure roller 102, and if the passing means 2 detect that the bag 1 has still not passed to the passage 105, then the diverter element 103 would change its position so that the bags proceed to the predetermined destination and, at the same time, the machine will gradually come to a stop.

This invention describes a new sorting module for bag checking machines. The examples mentioned herein are not intended to limit the present invention, which may have different applications and/or adaptations, all of which are within the scope of the following claims.

The invention claimed is:

1. A bag checking machine with a sorting module, installed before the bag can enter the checking machine, characterized in that the bag checking machine comprises:

a pressure roller (102) that puts pressure on the bags (1) as they pass through under said roller (102), which has an ascending and a descending motion, a first input roller (101) adjacent to and facing a conveyance means (4) of the bag checking machine and connected to the pressure roller (102), and at least one automatic or manually-operated diverter element (103) positioned below pressure roller (102), which has at least two positions, a first upward position that blocks the passing of the bags towards the conveyance means (4) and guides the bags towards another predetermined destination, and a second downward position that defines a passage (105) formed by the conveyance means (4), said diverter element (103) blocks the passing of the bags (1) towards the other predetermined destination and guides the bags (1) towards the passage (105).

2. The bag checking machine according to claim 1 characterized in that the pressure roller (102) is driven by the conveyance means (4) and is integrated with the conveyance means.

3. The bag checking machine according to claim 2, characterized in that it comprises a second input roller (104) connected to the pressure roller (102).

4. The bag checking machine according to claim 2, characterized in that the at least one diverter element (103) is a nail.

5. The bag checking machine according to claim 4, characterized in that when the at least one nail (103) takes the upwards position, the pressure roller (102) likewise moves upwards, and the nails (103) block the passing of the bags (1) to the conveyance means (4).

6. The bag checking machine according to claim 5, characterized in that it comprises passing means (2) and when said passing means (2) detect a delay in the passing of the bags (1) the pressure roller (102) moves upwards and if the passing means (2) continues detecting the delay of the bags, they move the at least one nail (103) to an upwards position, thus blocking the passing of the bags (1) towards the conveyance means (4).

7. The bag checking machine according to claim 1, characterized in that the pressure roller (102) is driven by friction.

8. The bag checking machine according to claim 7, characterized in that it comprises a second input roller (104) connected to the pressure roller (102).

9. The bag checking machine according to claim 7, characterized in that the at least one diverter element (103) is a nail.

10. The bag checking machine according to claim 1, characterized in that the pressure roller (102) is an independent driving means.

11. The bag checking machine according to claim 10, characterized in that it comprises a second input roller (104) connected to the pressure roller (102).

12. The bag checking machine according to claim 10, characterized in that the at least one diverter element (103) is a nail.

* * * * *